United States Patent [19]

Chandra et al.

[11] Patent Number: 4,571,123

[45] Date of Patent: Feb. 18, 1986

[54] BOAT LANDING STAGE FOR MARINE PLATFORM

[75] Inventors: Tapan K. Chandra, Gretna, La.; Jonathan C. Major, Kyungman, Rep. of Korea

[73] Assignee: Texaco Inc., White Plains, N.Y.

[21] Appl. No.: 606,084

[22] Filed: May 1, 1984

[51] Int. Cl.[4] ..... E02B 3/22; E02B 17/02

[52] U.S. Cl. ..... 405/212; 405/224

[58] Field of Search ..... 405/212, 213, 214, 215, 405/224, 227; 114/219

[56] References Cited

U.S. PATENT DOCUMENTS 2,844,943 7/1958 Kennedy ..... 405/213

3,464,214 9/1969 King ..... 405/214

4,337,009 6/1982 Jackson ..... 405/212

*Primary Examiner*—David H. Corbin

*Attorney, Agent, or Firm*—Robert A. Kulason; James J. O'Loughlin; Robert B. Burns

[57] ABSTRACT

An offshore marine structure particularly adapted for use in tidal waters, which structure includes a steel jacket capable of supporting an operating equipment deck. A boat landing or stage is attached to the jacket after installation of the latter at an offshore site. The boat landing can thereby be guidably and vertically positioned above the water's mean surface level by adjustment along a tracking member prior to being affixed in place on the structure.

7 Claims, 6 Drawing Figures

BOAT LANDING STAGE FOR MARINE PLATFORM

BACKGROUND OF THE INVENTION

Offshore marine structures of the type contemplated are often used for drilling wells and producing hydrocarbons from reservoir sites beneath varying water depths. Depending on the location of these sites, the tidal difference in the water level can vary from several feet, to perhaps in excess of 5 feet.

Platforms and marine structures of this type must be capable of withstanding adverse weather situations. Extreme and stormy conditions are countered where waves can be greater than 75 feet high above mean water level.

Such platforms therefore are fixed to the underwater site by piling or similar means which will give them a positive, firm hold. They must also support the weight of the deck together with its ancillary equipment, as well as resist the foul weather.

In any instance, means must be provided on the structure for accommodating work boats and other floating craft which pull alongside. The latter are a necessary adjunct to the operation of any offshore platform since they carry supplies and tools to assure a continuous operation. Such work boats also carry personnel and crews which are usually rotated on a cyclical basis.

In summary, the use of boats in conjunction with offshore operations is a necessary expedient in achieving functions which cannot be performed by helicopter.

To function properly, any boat landing attached to offshore structures should be adjustable to accommodate the boat regardless of the tides and the general condition of the water about the platform. However, due to the extremely rough conditions which are to be expected, it is found to be highly impractical to make a boat landing which is operable and which can be adjusted to a prevailing condition.

It is expeditious therefore to install the structure's boat landing in such manner that it will accommodate approaching boats under situations which normally might prevail at the platform regardless of the mean water level.

The usual precedure for providing an offshore working site with a marine structure capable of drilling or producing hydrocarbons, is to design and fabricate the structure at a boat yard or similar onshore facility. At this point the steel supporting jacket is assembled in such manner that enough of its members are sealed and buoyancy controlled that the platform can be transported to the site by barge. It is then controllably sunk in a substantially vertical or upright position. Once the structure is resting on the ocean floor, it is fixed there by the usual piling which extends through the structure's legs and into the substrate. The piling is embedded a sufficient distance to firmly anchor the unit.

Normally the height of a marine structure can be accurately determined in accordance with the condition of the substrate into which the piles will be driven. It is virtually impossible, however, to accurately determine the exact mean water level along the platform legs. This is true since the entire unit will tend to sink into the floor of the offshore site an uncertain distance during installation.

Since the ultimate level to which the water will rise on an installed platform's legs is unknown at the time of construction, it is difficult to initially install a boat landing which will be ideally suited on the structure for normal usage.

For example if the landing is installed too low on the platform legs, should the latter sink an inordinate amount into the ocean floor a fixed boat landing might be underwater at all times and of minimal usage. On the other hand, if the landing is initially installed too high, it could be too far above the deck of approaching vessels and again be of minimal usage from a practical point of view.

What is presently provided in an offshore platform to overcome the above enumerated problems is a marine structure, which includes a boat landing that depends from one side thereof. The boat landing or stage is partially installed on the structure at the onshore fabrication yard and prior to being barged to the offshore site.

In anticipation of the installation, at least two of the marine structure's upstanding legs are furnished with a tracking system that will operably receive a boat landing and yet permit subsequent vertical adjustment to a desired elevation. After the structure has been piled into its permanent location, the boat landing can then be moved to a height compatible with the actual mean water level on the platform's legs.

It is therefore an object of the invention to provide an offshore structure of the type contemplated having a boat landing or stage which is properly positioned relative to the level of water about the platform.

A further object is to provide a boat landing for an offshore structure that is installed subsequent to the structure being fixed to the floor of an offshore working site.

A still further object is to provide a boat landing that is installed at an offshore site by vertically adjusting the boat landing substructure or tracking system on a provisional basis prior to the platform being fixed to the ocean floor.

DESCRIPTION OF THE DRAWINGS

Referring to FIG. 1, an offshore structure 10 of the type presently contemplated is comprised basically of an elongated jacket formed essentially of a plurality of upstanding legs 11 and 12. The latter as shown, are generally in a battered condition rather than being vertically oriented with respect to the deck 13. This arrangement of the support legs provides a more stable base to the structure thereby assuring its integrity in all types of weather conditions.

Figure 1:
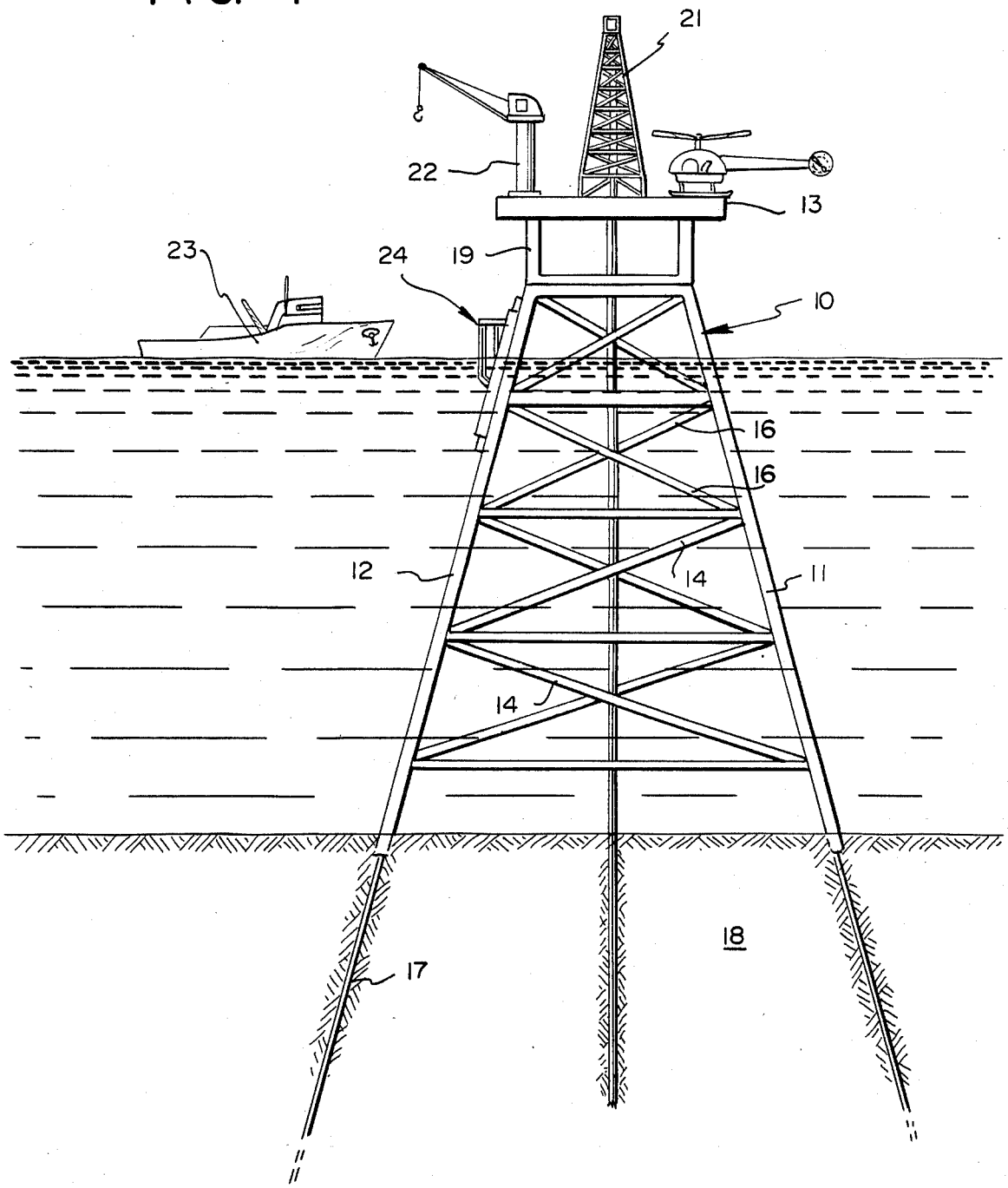
FIG. 1 is an elevation view of an offshore marine structure of the type contemplated which includes a jacket which is fixedly piled to the ocean floor.

The respective support legs 11 and 12 are mutually connected through a series of horizontal bracing members 14 and cross members 16 disposed therebetween. These lateral support elements are spaced vertically along the respective legs to afford maximum strength, and yet provide minimum weight to the overall structure.

The upstanding legs 11 and 12 are normally fabricated in the form of steel tubular members which are end welded one to the other to afford the necessary leg length in accordance with the depth of water at which the structure is installed. The respective legs are provided along their interior or along their exterior surface with means to accommodate the necessary piles 17 which are driven to anchor the structure to the ocean floor 18. These piles 17 as is known, are driven to a desired depth contingent on the consistency of the substrata and grouted in place. Further, the number of piles employed is a function of the weight of the platform and the condition of the substrata.

The upper end of the jacket is adapted to meet with vertical columns 19 and receive deck unit 13. The deck is comprised primarily of a multilayered structure which defines a series of horizontally arranged floors or areas for working, storing produced product, and crew's quarters. Each deck is normally provided with at least one derrick 21 together with a rotary table. Also normally carried on deck 13 is one or more cranes 22 which are positioned to reach out beyond the edge of the deck for transferring equipment to and from vessels alongside the structure.

As shown in FIG. 1, the jacket is provided with a boat landing 24 on at least one side thereof to which floating vessels 23 can approach and be fastened for the purpose of transferring cargo. Boat landing 24 as seen, is preferably disposed at the water level such that it is at most convenient location to transfer the cargo and personnel from the vessel and deck 13 if the condition of the water warrants such transfer.

For the following description, legs 11 and 12 are assumed to be battered in one plane, as shown in FIG. 1. However, when viewed from the landing side of the structure, they might be parallel or battered in two planes. In such an instance, boat landing 24 will preferably comprise a unitary structure that bridges the two legs.

Figure 2:
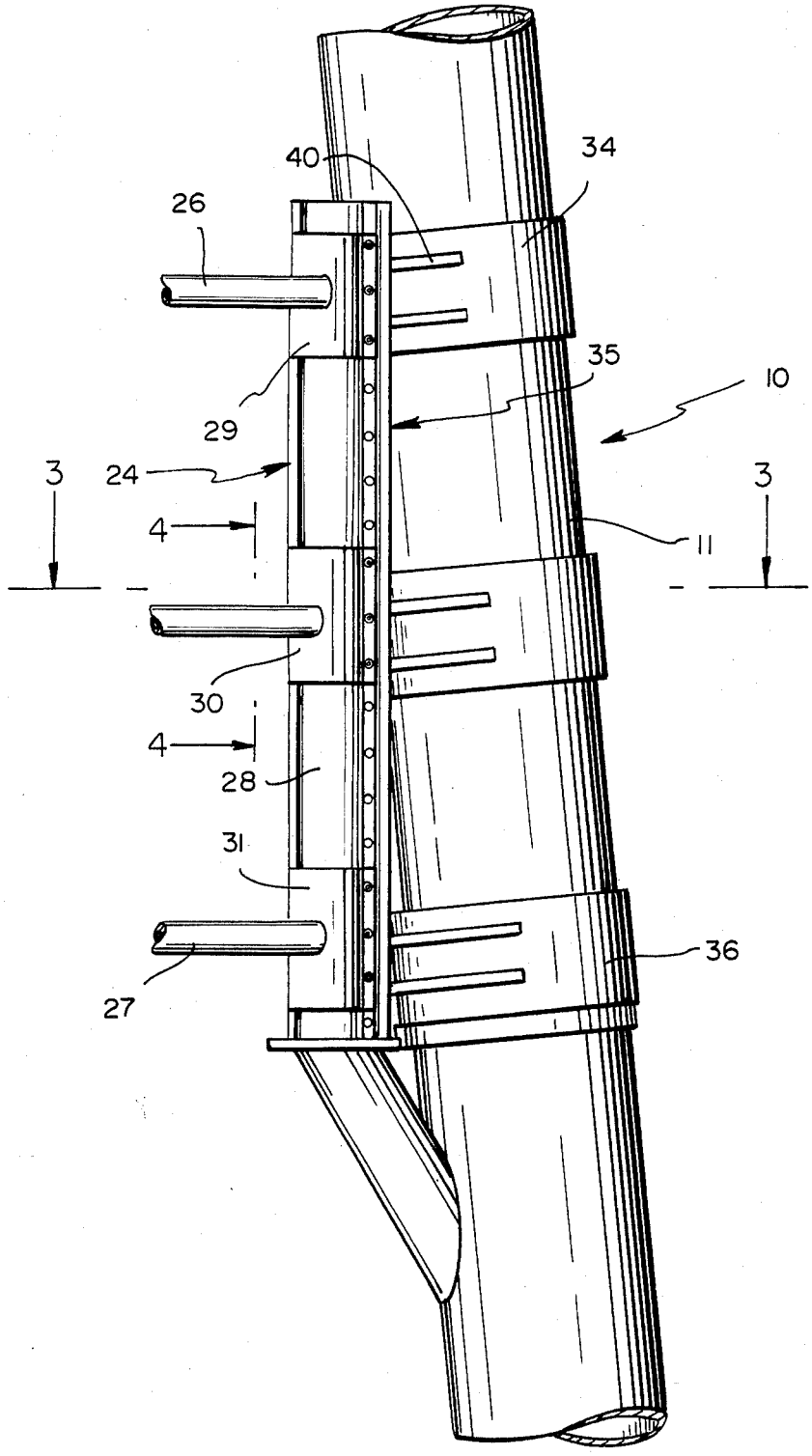
FIG. 2 is a segmentary view on an enlarged scale of the boat landing portion of the platform shown in FIG. 1.
Figure 5:
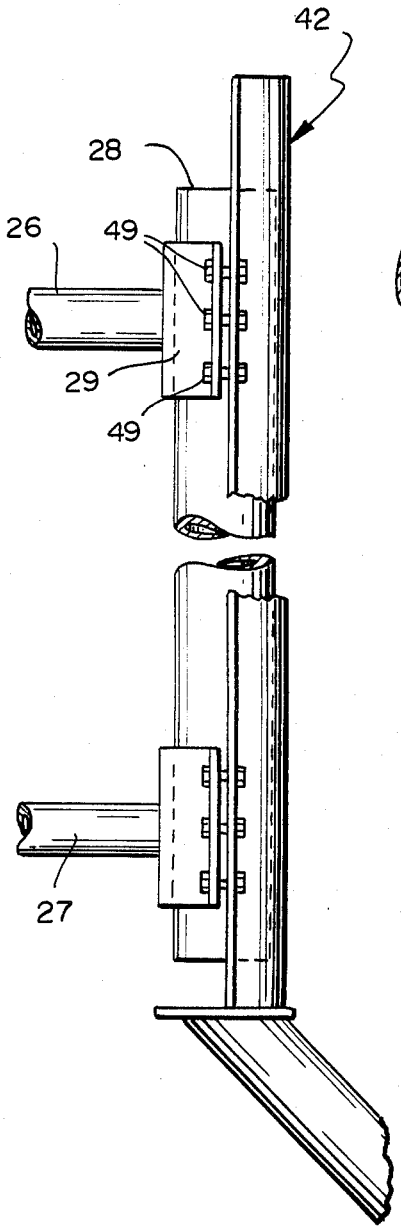
FIG. 5 is similar to the view shown in FIG. 2 but viewed from the side and segmented to remove the support leg.
Figure 3:
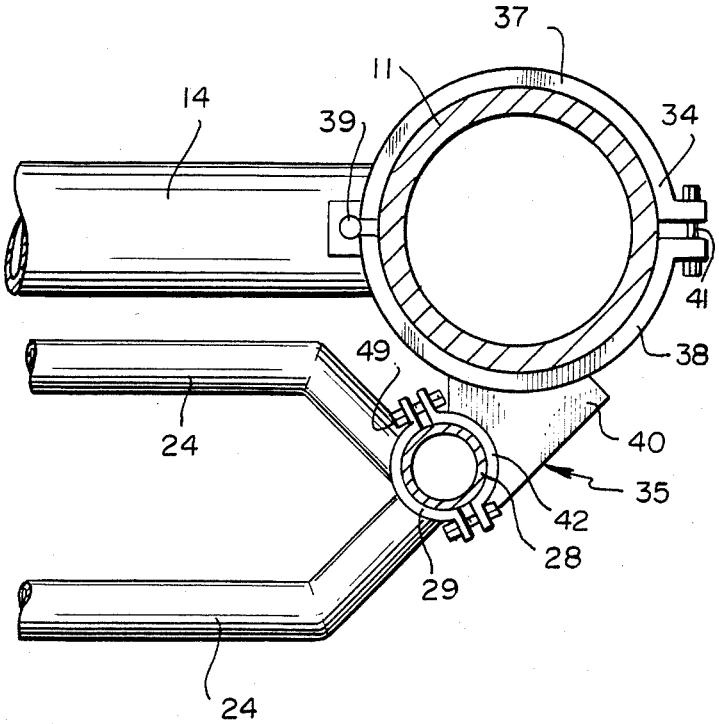
FIG. 3 is a cross-sectional view taken along line 3—3 of FIG. 2.
Figure 6:
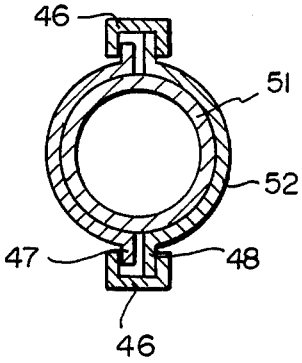
FIG. 6 is a view of an alternative connection of boat landing to tracking system.
Figure 4:
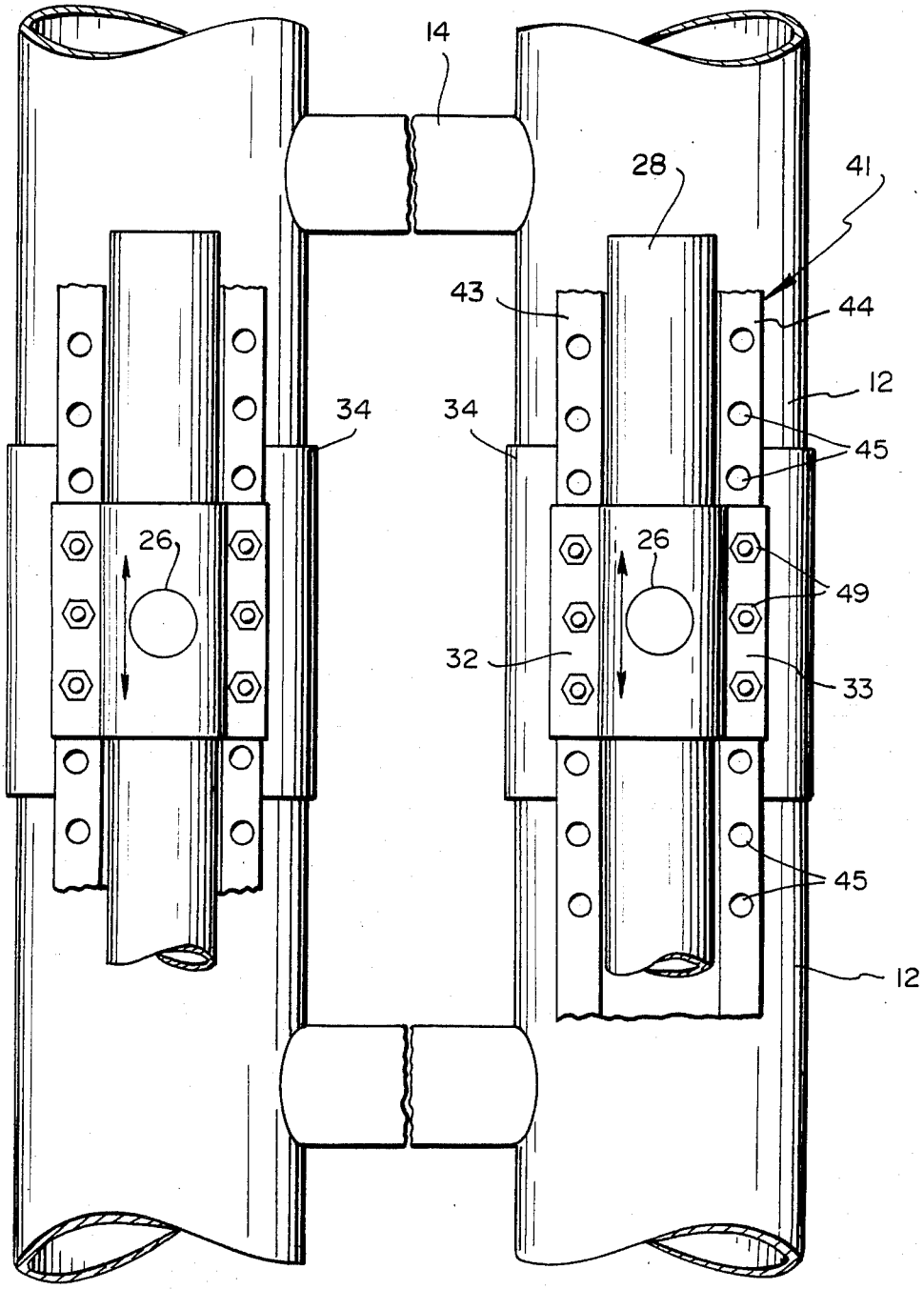
FIG. 4 is an enlarged segmentary view of a portion of the details of FIG. 1 viewed from line 4—4.

Referring to FIGS. 2, 3, and 5, a section of boat landing 24 is shown fastened to a jacket's battered leg 11. The boat landing substructure as shown is comprised of a plurality of horizontally spaced stringers 26 and 27 which extend away from the jacket, and are adapted to receive the necessary components of the boat landing.

The substructure is further comprised of an elongated main column 28 preferably in tubular form, made of steel and coated to resist rusting and deterioration due to constant exposure to salt water spray. Main column 28 as shown includes a plurality of spaced apart mounting brackets 29, 30, and 31, formed in a generally semicircular configuration having outstanding flanges 32 and 33 on opposed sides thereof. Each flange is provided with a series of aligned fastening openings which are substantially equispaced from the longitudinal axis of main column 28.

Operationally the boat landing substructure would engage various docking members, guard rails, boat bumpers and the like, all adapted to facilitate the mooring or positioning of a boat adjacent thereto for a transfer operation.

The boat landing substructure is fastened to a tracking system 35 which is comprised of two distinct, although substantially identical upright members. Each of said members is fastened to and depends from an adjacently positioned leg 11 and 12.

In the illustrated embodiment support legs 11 and 12 as noted, are shown in a battered position. However, and as herein noted, said legs can assume a generally vertical or upright disposition. In any event each tracking system segment is fastened to a separate leg 11, by a plurality of circular, spaced apart clamps 34 and 36.

In one embodiment, and as shown in FIG. 3, circular clamp 34 can comprise a pair of hinged ring segments 37 and 38 which are operably connected at pin 39 on one side. The ring segments are fastened in place about support leg 11 by a second locking pin or bolt at 41. The respective leg clamps 34 and 36 as shown are vertically spaced along support leg 11 and are normally applied to the leg at a shipyard and prior to the structure being barged to its working position and submerged.

Each segment of the horizontally spaced tracking system is comprised primarily of an elongated tracking element 41. The latter is shaped to define a guide channel therein and is conformed to slidably receive main column 28 of the boat landing subsection. Said element 41 is connected to the respective leg clamps by an intermediate gusset plate 40.

In one embodiment, tracking element 41 is comprised of a semicircular member having a sufficient diameter to reeive main column 28 of the boat landing substructure. A pair of fastening strips 43 and 44 depend laterally from opposed sides of tracking element 41, each being provided with a series of the aligning holes 45.

Aligning holes 45 in the respective tracking member 41, and in the mounting brackets 29, 30 and 31, are arranged to be vertically equispaced as well as being spaced equally from the longitudinal axis of main column 28.

Each of the respective adjacently positioned platform legs 11 and 12 is provided with one segment of the tracking system 41. However, when the latter is fastened to the support legs the horizontal distance between the center of the respective tracking element guide channels, corresponds to the horizontal distance between the spaced apart main columns 28 on the boat landing substructure. Thus, when the latter is registered within the spaced apart guide channels, the boat landing can be vertically, yet guidably adjusted to a desired height.

An alternate embodiment of the apparatus illustrating the relationship between the boat landing and the tracking system is shown in FIG. 7. Here, one or both cooperating members can be provided with guide shoes 46. The latter extend outward of the respective flanges 47 and 48, being fastened to one and being slidably registered on the other. By being loosely retained, the boat landing substructure column 51 can be slidably moved along the curved tracking channel 52 without concern that it will be dislodged from the latter prior to being fastened into position.

Operationally, the boat landing substructure is positioned in its corresponding guide channels with track element 41, prior to marine structure 10 being barged to a working site and submerged. When provisionally fastened in place by bolts 49, the boat landing can be adjusted to an elevation approximating its final position as determined by the mean water level on the support leg. Thus, the boat landing is provisionally retained in place by a plurality of bolts 49 which register in the alignment holes 45 on the respective mounting brackets 29, 30 and 31, and the guide element or channel 41.

At the working site the structure is launched from its barge and permitted to sink beneath the water to rest on the ocean floor in an upright position. When so positioned, the unit will sink into the ocean floor a certain distance until resistance of the substrate prevents further sinking.

When the structure has stabilized in an upright position, the piling operation will commence. During this time, piles 17 are driven down the respective legs and cemented in place to firmly anchor the structure.

At this phase of the operation, the mean water level at support legs 11 and 12 is accurately determined. If the unit had been properly designed, the tracking system will extend for a distance both above and below the mean level of the water.

Since the boat landing substructure is temporarily retained in its guide system, it can be released by divers. This is achieved by removing fastening bolts 49, thereby permitting boat landing substructure to be slid either up or down along the guide track in track element 41, until it reaches the optimal position for receiving a floating vessel. Vertical adjustment can be achieved either through an external crane barge adjacent to the platform, by utilizing crane 22 on deck 13, or by other special purpose rigging.

When the ultimate vertical position of the boat landing has been established with respect to the tracking system, fastening bolts 49 can be passed through the corresponding alignment holes 45 in the aligned mounting brackets and the tracking element, and fastened by bolts 49, thereby permanently securing the boat landing in place.

Although modifications and variations of the invention may be made without departing from the spirit and scope thereof, only such limitations should be imposed as are indicated in the appended claims.

We claim:

1. In a marine structure adapted for installation in an offshore body of water including; a jacket having a plurality of upstanding, spaced apart legs which support a deck above the water's surface, and means for fixing said jacket to the ocean floor at an offshore site, which structure includes;

an elongated tracking element 35 carried on each of at least two of said spaced apart legs, said tracking element extending for a distance above and below what will be the predetermined mean water level on said legs at said offshore site, said tracking element including; an elongated guide channel 42 having equispaced locating holes 45 aligned parallel with said tracking element longitudinal axis.

a boat landing substructure 24 which includes; a main column 28 slidably registered in said tracking element 35, a plurality of mounting brackets 29, 30, 31 depending from said main column 28, and locking means 49 adapted to releasably engage said main column 23 plurality of mounting brackets 29, 31 to said tracking element, whereby, said boat landing substructure 24 can be slidably adjusted longitudinally of said elongated tracking element 35 to position said boat landing structure at a desired elevation with respect to the water's surface after said marine structure has been installed at said offshore site.

2. In a marine structure as defined in claim 1, wherein said at least two spaced apart legs are disposed parallel to each other.

3. In a marine structure as defined in claim 1, wherein said spaced apart legs are arranged in non-parallel relationship, and said boat landing substructure comprises two discrete segments, each segment being carried on one of said non-parallel spaced apart legs.

4. In a marine structure as defined in claim 1, wherein said boat landing substructure includes; two spaced apart main columns which are disposed in parallel relationship and registered in said tracking element on the spaced apart legs.

5. In a marine structure as defined in claim 1, wherein said tracking element includes; clamping means adapted to be operably connected to a support leg.

6. In a marine structure as defined in claim 1, wherein said elongated guide channel defines a concave surface facing outwardly from said support leg, and said main column is circular in cross-section.

7. In a marine structure as defined in claim 1, wherein said mounting brackets include longitudinally spaced apart holes that are adapted for alignment with corresponding holes in said tracking element whereby to accommodate said locking means to maintain said main column in engagement with said tracking element.

* * * * *